US010415392B2

(12) United States Patent
Lohaus

(10) Patent No.: US 10,415,392 B2
(45) Date of Patent: Sep. 17, 2019

(54) END WALL CONFIGURATION FOR GAS TURBINE ENGINE

(71) Applicant: Siemens Energy, Inc., Orlando, FL (US)

(72) Inventor: Andrew S. Lohaus, Berlin (DE)

(73) Assignee: SIEMENS ENERGY, INC., Orlando, FL (US)

( * ) Notice: Subject to any disclaimer, the term of this patent is extended or adjusted under 35 U.S.C. 154(b) by 326 days.

(21) Appl. No.: 15/307,087

(22) PCT Filed: Jun. 18, 2014

(86) PCT No.: PCT/US2014/042911

§ 371 (c)(1),
(2) Date: Oct. 27, 2016

(87) PCT Pub. No.: WO2015/195112

PCT Pub. Date: Dec. 23, 2015

(65) Prior Publication Data

US 2017/0089203 A1 Mar. 30, 2017

(51) Int. Cl.
*F01D 5/14* (2006.01)

(52) U.S. Cl.
CPC ..... *F01D 5/143* (2013.01); *F01D 5/14* (2013.01); *F01D 5/141* (2013.01); *F01D 5/147* (2013.01); *F05D 2240/12* (2013.01); *F05D 2240/124* (2013.01); *F05D 2240/303* (2013.01); *F05D 2240/306* (2013.01); *F05D 2240/80* (2013.01)

(58) Field of Classification Search
CPC . F01D 5/14; F01D 5/141; F01D 5/143; F01D 5/145; F01D 5/147; F05D 2240/12; F05D 2240/121; F05D 2240/123; F05D 2240/124; F05D 2240/303; F05D 2240/306; F05D 2240/80
See application file for complete search history.

(56) References Cited

U.S. PATENT DOCUMENTS 6,283,713 B1 9/2001 Harvey et al.
6,561,761 B1 5/2003 Decker et al.
(Continued)

FOREIGN PATENT DOCUMENTS

CA 2771349 C * 9/2017
EP 0997612 A2 5/2000
(Continued)

OTHER PUBLICATIONS

PCT International Search Report and Written Opinion dated Oct. 24, 2014 corresponding to PCT Application PCT/US2014/042911 filed Jun. 18, 2014. (12 pages).

*Primary Examiner* — Dwayne J White
*Assistant Examiner* — Danielle M. Christensen

(57) ABSTRACT

A contoured turbine airfoil assembly including an end wall (30*a*) formed by platforms (30) located circumferentially adjacent to each other, and a row of airfoils (34*a*, 34*b*) integrally joined to the end wall (30*a*) and spaced laterally apart to define flow passages (46) therebetween for channeling gases in an axial direction. A trough (62) is defined between a pressure side ridge (48) and a suction side ridge (58) located forward of each pair of airfoils (34*a*, 34*b*). Each trough (62) has a direction of elongation aligned to direct flow into the flow passage (46) centrally between each pair of airfoils (34*a*, 34*b*).

5 Claims, 4 Drawing Sheets

(56) References Cited

U.S. PATENT DOCUMENTS

| | | | | |
|---|---|---|---|---|
| 6,669,445 | B2 | 12/2003 | Staubach et al. | |
| 6,969,232 | B2 | 11/2005 | Zess et al. | |
| 7,134,842 | B2 | 11/2006 | Tam et al. | |
| 7,217,096 | B2 | 5/2007 | Lee | |
| 7,220,100 | B2 | 5/2007 | Lee et al. | |
| 7,249,933 | B2 | 7/2007 | Lee et al. | |
| 7,690,890 | B2 | 4/2010 | Aotsuka et al. | |
| 7,887,297 | B2 | 2/2011 | Allen-Bradley et al. | |
| 8,105,037 | B2 | 1/2012 | Grover et al. | |
| 8,177,499 | B2 | 5/2012 | Iida | |
| 8,192,153 | B2 | 6/2012 | Harvey et al. | |
| 8,206,115 | B2 | 6/2012 | Gupta et al. | |
| 8,231,353 | B2 | 7/2012 | Siden et al. | |
| 8,356,975 | B2 | 1/2013 | Grover et al. | |
| 8,439,643 | B2 | 5/2013 | Kuhne et al. | |
| 8,459,956 | B2 | 6/2013 | Pandey et al. | |
| 8,511,978 | B2 | 8/2013 | Allen-Bradley et al. | |
| 9,376,927 | B2 * | 6/2016 | Stein | F01D 9/041 |
| 2011/0223005 | A1 | 9/2011 | Lee et al. | |
| 2013/0224027 | A1 | 8/2013 | Barr et al. | |
| 2014/0090401 | A1 | 4/2014 | Praisner et al. | |
| 2015/0110618 | A1 * | 4/2015 | Stein | F01D 9/041 415/208.2 |

FOREIGN PATENT DOCUMENTS

| | | | |
|---|---|---|---|
| EP | 2241721 | A2 | 10/2010 |
| EP | 2642075 | A2 | 9/2013 |
| JP | 2008248701 | A | 10/2008 |
| WO | 03052240 | A2 | 6/2003 |

* cited by examiner

END WALL CONFIGURATION FOR GAS TURBINE ENGINE

STATEMENT REGARDING FEDERALLY SPONSORED DEVELOPMENT

Development for this invention was supported in part by Contract No. DE-FC26-05NT42644, awarded by the United States Department of Energy. Accordingly, the United States Government may have certain rights in this invention.

TECHNICAL FIELD

The present invention relates generally to gas turbine engines and, more particularly, to end wall configurations for airfoil assemblies in gas turbine engines.

BACKGROUND ART

A gas turbine engine typically includes a compressor section, a combustor, and a turbine section. The compressor section compresses ambient air that enters an inlet. The combustor combines the compressed air with a fuel and ignites the mixture creating combustion products defining a working fluid. The working fluid travels to the turbine section where it is expanded to produce a work output. Within the turbine section are rows of stationary vanes directing the working fluid to rows of rotating blades coupled to a rotor. Each pair of a row of vanes and a row of blades forms a stage in the turbine section.

Advanced gas turbines with high performance requirements attempt to reduce the aerodynamic losses as much as possible in the turbine section. This in turn results in improvement of the overall thermal efficiency and power output of the engine. One possible way to reduce aerodynamic losses is to incorporate end wall contouring on the blade and vane shrouds in the turbine section. End wall contouring when optimized can result in a significant reduction in the effects of secondary flow vortices which can contribute to losses in the turbine stage.

SUMMARY OF INVENTION

In accordance with an aspect of the invention, a contoured turbine airfoil assembly is provided including an end wall formed by platforms located circumferentially adjacent to each other, and a row of airfoils integrally joined to the end wall and spaced laterally apart to define flow passages therebetween for channeling gases in an axial direction. Each of the airfoils include a concave pressure side and a laterally opposite convex suction side extending in a chordwise direction between opposite leading and trailing edges, the chordwise direction extending generally in the axial direction. A pressure side ridge is associated with each airfoil and is defined by an elongated crest extending from a location forward of the mid-chord on the pressure side of an associated airfoil and extending to a location axially forward of the leading edges of the airfoils.

The pressure side ridge can extend circumferentially into the flow passage between the pair of airfoils.

The elongated crest of the pressure side ridge can extend from about 15% upstream to about 10% downstream of the leading edge of each airfoil, measured relative to the chord length of the airfoils.

The pressure side ridge can extend to and define a raised area on a forward edge of the end wall.

A suction side ridge can be associated with each airfoil and can be defined by an elongated crest located forward of the leading edges of the airfoils, and a trough can be defined between the pressure side ridge and the suction side ridge for each pair of airfoils, the troughs having a direction of elongation aligned to direct flow into the flow passage centrally between each pair of airfoils.

An upstream edge of the end wall can define an undulating surface extending in the circumferential direction.

In accordance with another aspect of the invention, a contoured turbine airfoil assembly is provided including an end wall formed by platforms located circumferentially adjacent to each other, and a row of airfoils integrally joined to the end wall and spaced laterally apart to define flow passages therebetween for channeling gases in an axial direction. Each of the airfoils include a concave pressure side and a laterally opposite convex suction side extending in a chordwise direction between opposite leading and trailing edges, the chordwise direction extending generally in the axial direction. Troughs are defined in the end wall and are located forward of the leading edges of the airfoils and extend to an axial location at least even with the leading edges of the airfoils. The troughs have a direction of elongation aligned to direct flow into the flow passage centrally between each pair of airfoils.

Each trough can be defined between a pressure side ridge and a suction side ridge for each pair of airfoils, each pressure side ridge can extend from a pressure side of an associated airfoil forwardly of the leading edge of the associated airfoil and the suction side ridge can have an elongated crest extending adjacent to the suction side of an associated airfoil and located forward of the leading edges of the airfoils.

The trough can extend from an upstream edge of the end wall, and the upstream edge of the end wall can define an undulating surface extending in the circumferential direction.

The end wall adjacent to a suction side mid-chord location of each airfoil can include a mid-chord bulge, the mid-chord bulge defining a higher elevation than a circumferentially opposite, pressure side mid-chord location of an adjacent airfoil.

A continuous low elevation channel can be defined extending in the circumferential direction between the mid-chord bulge and the pressure side mid-chord location at the adjacent airfoil.

The continuous low elevation channel can be defined by a region having an axial extent without ridges and troughs, and extending circumferentially between the mid-chord bulge and the pressure side mid-chord location at the adjacent airfoil.

In accordance with a further aspect of the invention, a contoured turbine airfoil assembly is provided including an end wall formed by platforms located circumferentially adjacent to each other, and a row of airfoils integrally joined to the end wall and spaced laterally apart to define flow passages therebetween for channeling gases in an axial direction. Each of the airfoils include a concave pressure side and a laterally opposite convex suction side extending in a chordwise direction between opposite leading and trailing edges, the chordwise direction extending generally in the axial direction. A mid-chord bulge is located on the end wall adjacent to a suction side mid-chord location of each airfoil, the mid-chord bulge defining a higher elevation than a circumferentially opposite, pressure side mid-chord location of an adjacent airfoil.

The mid-chord bulge can extend from the suction side of each airfoil laterally to an outer edge, and the elevation of the bulge can decrease in axially forward and aft directions at locations where the mid-chord bulge intersects the suction side of the airfoil.

A continuous low elevation channel can be defined extending in the circumferential direction between the mid-chord bulge and the pressure side mid-chord location at the adjacent airfoil.

The continuous low elevation channel can be defined by a region having an axial extent without ridges and troughs, and extending circumferentially between the mid-chord bulge and the pressure side mid-chord location at the adjacent airfoil.

The mid-chord ridge can be generally semi-spherical at the suction side of each airfoil.

A pressure side ridge can be associated with each airfoil and defined by an elongated crest extending from a location forward of the pressure side mid-chord location at the adjacent airfoil and extending to a location axially forward of the leading edges of the airfoils.

A suction side ridge can be associated with each airfoil and defined by an elongated crest located forward of the leading edges of the airfoils, and each pressure side ridge can be positioned at a circumferential location between the circumferential locations of the leading edges of adjacent airfoils.

A trough can be defined between the pressure side ridge and the suction side ridge for each pair of airfoils, the trough having a direction of elongation aligned to direct flow into the flow passage centrally between each pair of airfoils.

BRIEF DESCRIPTION OF DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DESCRIPTION OF EMBODIMENTS

In the following detailed description of the preferred embodiment, reference is made to the accompanying drawings that form a part hereof, and in which is shown by way of illustration, and not by way of limitation, a specific preferred embodiment in which the invention may be practiced. It is to be understood that other embodiments may be utilized and that changes may be made without departing from the spirit and scope of the present invention.

One possible way to reduce aerodynamic losses in the turbine section of a gas turbine engine is to incorporate end wall contouring on the vane and/or blade shrouds in the turbine section. End wall contouring when optimized can result in a significant reduction in secondary flow vortices which can contribute to high losses in the stage. In addition, end wall contouring can also help reduce heat load into the part, which may permit a reduction in the cooling requirements of the part as well as improving part life. However, it has been observed that, even with end wall contouring, the actual turbine efficiency may be lower than an efficiency predicted for an end wall contour design. Such losses may be due to a negative impact associated with an interaction between purge flow and secondary flows produced in flow passages between adjacent airfoils.

In accordance with an aspect of the invention, a configuration for end wall contouring is provided to prevent or limit mixing of the purge flow and the secondary flows. The end wall contour mitigates horseshoe and end wall vortices, and in accordance with a particular aspect of the invention, directs the purge flow as a substantially separate flow close to the end wall, spaced from and generally following the suction side of the airfoil.

Figure 1:
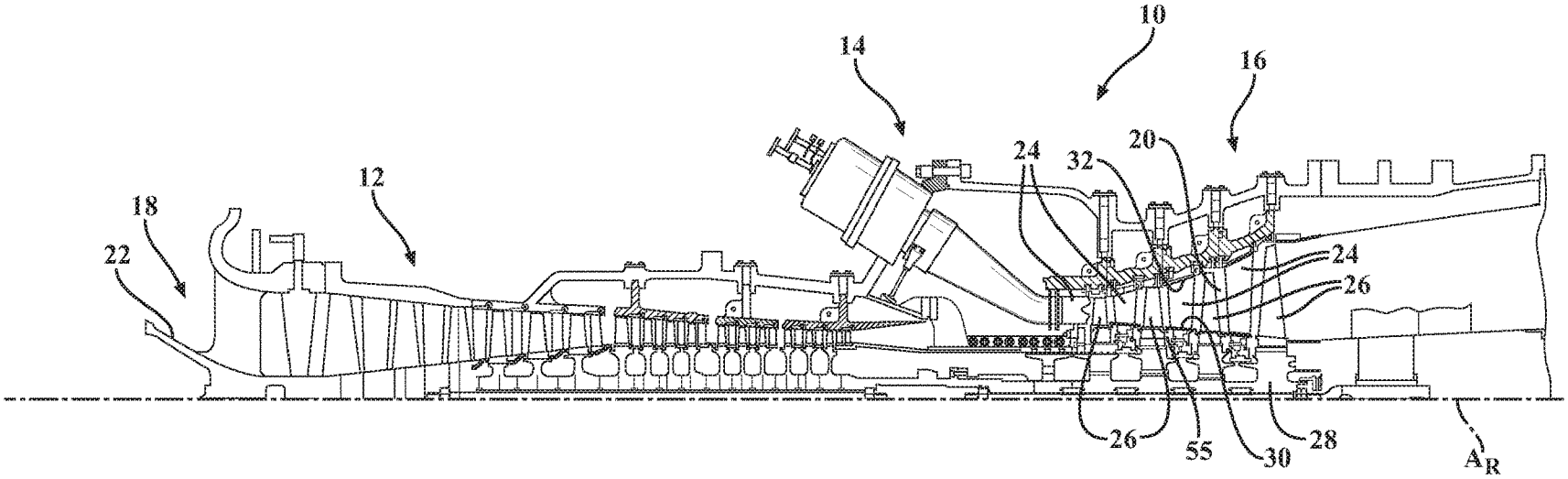
FIG. 1 is a partial cross-sectional view of a gas turbine engine incorporating an airfoil assembly formed in accordance with aspects of the invention.
Figure 2:
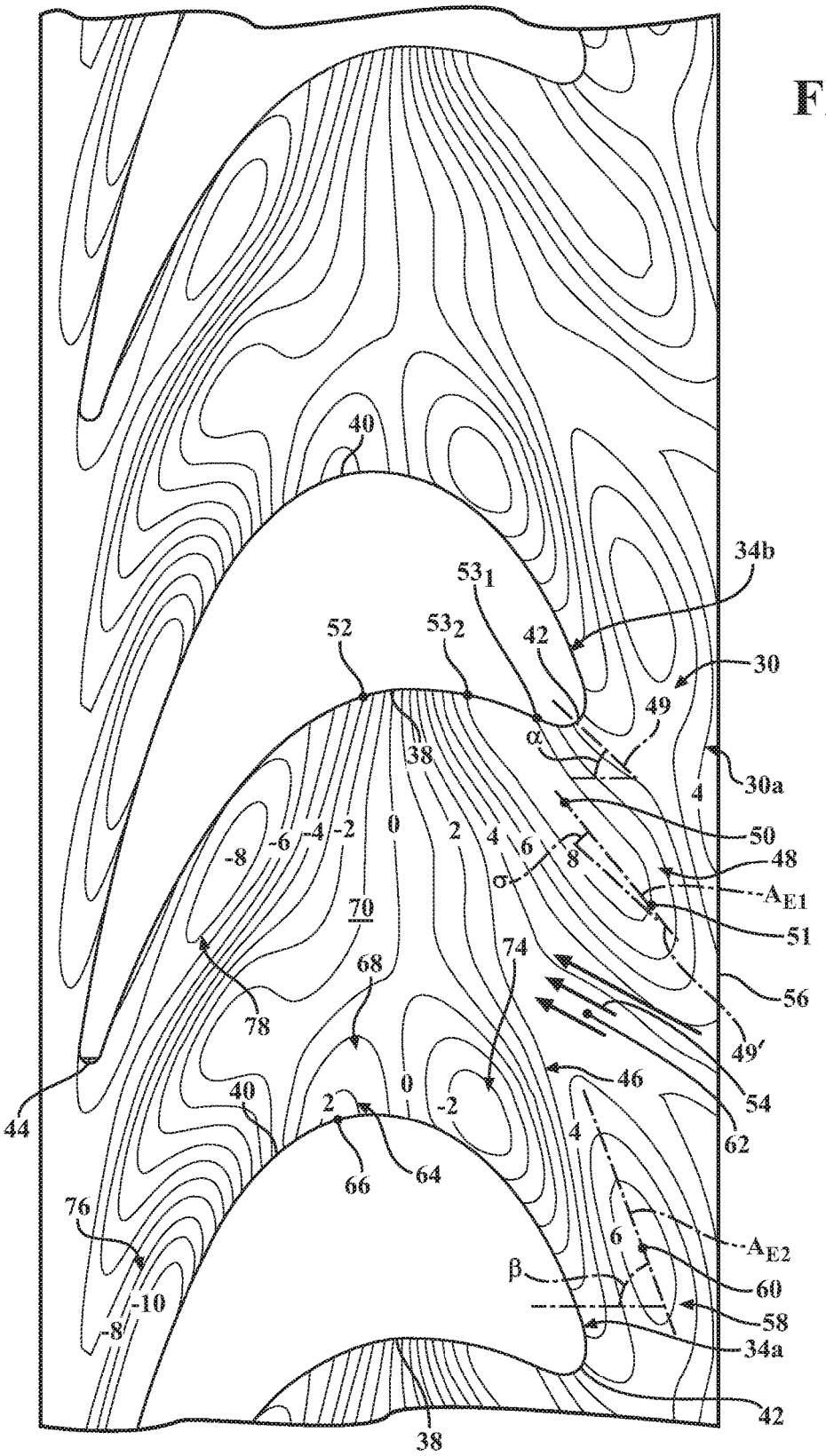
FIG. 2 is a plan view of an exemplary contoured end wall in accordance with aspects of the invention.

For purposes of the following description, it should be understood that "axial direction" refers to a direction parallel to the rotational axis $A_R$ of the rotor 28 (FIG. 1), and the "chordwise direction" or "chordwise dimension" is defined by a chord line having a length extending from the leading edge 42 to the trailing edge 44 of an airfoil 34*a*, 34*b* (FIG. 2). The terms "circumferential direction", "circumferentially" and "laterally" refer to a direction extending along an end wall 30*a* that is perpendicular to the axial direction. The terms "upstream" and "downstream" are described with reference to the direction of flow of hot gases through the flow path 20 and can correspond to the directions of "forward" and "aft", respectively. The terms "radially" and "elevation" refer to a direction that is perpendicular to both the axial and the circumferential directions. The term "mid-chord" refers to a location that is about 50% along the length of a chord line extending between the leading and trailing edges of an airfoil, measured in a circumferential direction from the chord line to the airfoil surface, and can include an axial span adjacent to a maximum of curvature of either the pressure or suction side of an airfoil.

FIG. 1 illustrates an exemplary a gas turbine engine 10 that can incorporate aspects of the present invention. The engine 10 includes a compressor section 12, a combustor 14, and a turbine section 16. The compressor section 12 compresses ambient air 18 that enters an inlet 22. The combustor 14 combines the compressed air with a fuel and ignites the mixture creating combustion products defining a working fluid. The working fluid travels to the turbine section 16. Within the turbine section 16 are rows of stationary vanes 24 and rows of rotating blades 26 coupled to a rotor 28, and each pair of rows of vanes 24 and blades 26 form a stage in the turbine section 16. The vanes 24 and blades 26 extend radially into an axial flow path 20 extending through the turbine section 16. The vanes 24 include a plurality of radially inner and outer shrouds or platforms 30, 32 integral with the vanes 24 and forming respective inner and outer end walls 30*a*, 32*a*. The working fluid expands through the turbine section 16 and causes the blades 26, and therefore the rotor 28, to rotate. The rotor 28 extends into and through the compressor 12 and may provide power to the compressor 12 and output power to a generator (not shown).

Referring to FIG. 2, a portion of a turbine stage is depicted with two adjacent airfoil structures including a first airfoil 34*a* and a second airfoil 34*b*, which for the present description may be understood to be airfoils associated with a row of vanes 24. However, it should be understood that the description and concepts presented herein could also be implemented in relation to a row of blades 26 comprising laterally spaced airfoils.

Figure 3:
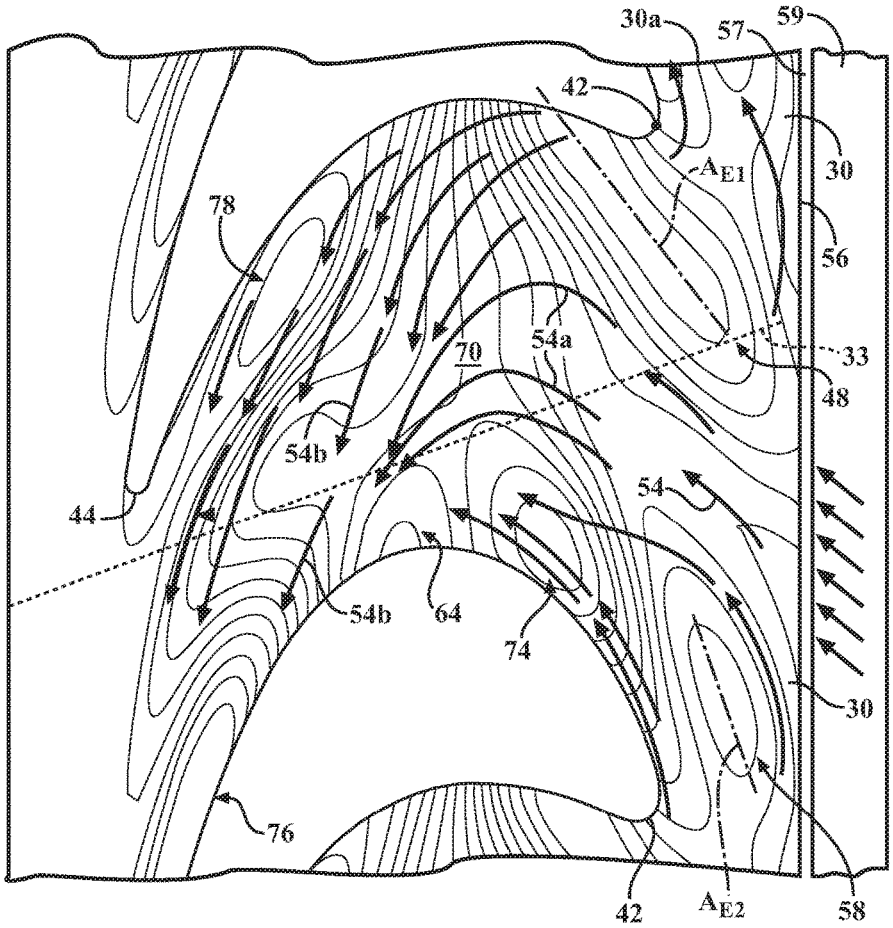
FIG. 3 is a plan view showing exemplary gas flows passing between a pair of airfoils on the end wall of FIG. 2.

The airfoils 34*a*, 34*b* are each integrally attached to a platform 30, 32 of respective radially inner and outer end walls 30*a*, 32*a*, only end wall 30*a* being shown in FIG. 2. It may be understood that one or more airfoils may be attached to a pair of inner and outer platforms 30, 32, and that the end walls 30*a*, 32*a* are continuous circumferential structures formed by the plurality of circumferentially adjacent platforms 30, 32. Plural inner platforms 30 located adjacent to each other at a junction (depicted by dotted line 33) formed between mating faces of the platforms 30, as seen in FIG. 3. Further, it should be understood that the airfoils 34*a*, 34*b* are referenced as representative of all of the airfoils forming the vane row 24, and that row of vanes 24 is formed by a plurality of identical airfoils 34*a*, 34*b* spaced laterally around the circumferential extent of the flow path 20.

The airfoils 34*a*, 34*b* each include a generally concave pressure side 38 and a generally convex suction side 40, each of the pressure and suction sides 38, 40 being defined by a radially extending spanwise dimension and an axially extending chordwise dimension, the chordwise dimension extending between a leading edge 42 and a trailing edge 44. The adjacent airfoils 34*a*, 34*b* form a flow passage 46 therebetween bounded by the radially inner and outer end walls 30*a*, 32*a*. During operation, the working fluid flows axially downstream through the flow passage 46 defined between the airfoils 34*a*, 34*b*. The airfoils 34*a*, 34*b* are shaped for extracting energy from the working fluid as the working fluid passes through the flow path 20.

In a prior or baseline configuration of a flow path between adjacent airfoils, such as one without end wall contouring, horseshoe vortices can be formed, extending downstream from a junction of the inner platform and the leading edge of the airfoil. The baseline configuration may be understood to be formed by platforms 30, 32 that have elevations which are nominally axisymmetric. The horseshoe vortices produced in the baseline configuration progress through the flow passage which can result in the creation of turbulence and can decrease the aerodynamic efficiency of the stage.

In accordance with an aspect of the invention, the end wall 30*a* illustrated in FIG. 2 has been configured with a specific 3D contour that, in accordance with one aspect of the invention, avoids or weakens the formation of horseshoe vortices and thereby improves the efficiency of the turbine 16. The 3D contour is depicted by contour lines of common elevation displaced from a nominally axisymmetric end wall, as described by a baseline configuration, and where the contour line depicted with a "0" value is a reference value that can correspond to the baseline end wall. It may be understood that the 3D contour is formed by continuous smooth surface elevation transitions between the depicted contour lines.

A pressure side ridge 48 is associated with each airfoil 34*a*, 34*b* and is described herein with particular reference to the airfoil 34*b*. The pressure side ridge 48 extends circumferentially into the flow passage 46 between the pair of airfoils 34*a*, 34*b*, and includes an elongated crest 50 defining a maximum elevation of the ridge 48 extending between an upstream location 51 that is axially forward of the leading edge of the airfoil 34*b* and a downstream location $\mathbf{53}_1$ that is downstream from the leading edge 42 and is forward of a mid-chord location 52 on the pressure side 38 of the airfoil 34*b*. The upstream location 51 is about 15% upstream of the leading edge 42 of each airfoil 34*b*, measured relative to the chord length of the airfoil 34*b*, and the downstream location $\mathbf{53}_1$ is about 10% downstream of the leading edge 42 of each airfoil 34*b*, measured relative to the chord length of the airfoil 34*b*. Further, the crest 50 has an axial extent along the pressure side 38, extending from the location $\mathbf{53}_1$, defining a forward location, to an aft location $\mathbf{53}_2$. The pressure side ridge 48 is angled to direct a purge flow 54 of gases passing axially through the flow passage 46. The purge flow 54 comprises purge or cooling air that passes into the flow path 20 from a purge cavity 55 (FIG. 1) located radially inward from the end wall 30*a*. In particular, the purge air can pass radially into the flow path 20 from the purge cavity 55 through a gap 57 (FIG. 3) between the inner end wall 30*a* and blade platforms 59 associated with the rotating blades 26.

An axis of elongation $A_{E1}$ of the crest 50 is oriented at an angle that is close to the leading edge metal angle, $\alpha$, which is described as an angle between the axial direction and a line 49 tangent to the mean camber line at the leading edge 42. In particular, the axis of elongation $A_{E1}$ of the crest 50 is oriented at an angle that is about 10° relative the leading edge metal angle, as indicated by an angle, $\sigma$, between the axis of elongation $A_{E1}$ and a line 49' that is parallel to the line 49. The pressure side ridge 48 extends to and defines a raised area at the forward edge 56 of the end wall 30*a*, and is configured to redirect flow upstream of the airfoil 34*b* to guide the purge flow 54 and to substantially reduce or eliminate formation of horseshoe vortices at the leading edge 42 of the airfoil 34*a*, 34*b* and extending into the flow passage 46 along the pressure side 38.

Referring to FIG. 2, a suction side ridge 58 is associated with each airfoil 34*a*, 34*b* and is described herein with particular reference to the airfoil 34*a*. The suction side ridge 58 is located adjacent to the suction side 40 of the airfoil 34*a* and includes an elongated crest 60 having an axial extent that is entirely located forward of the axial location of the leading edge 42. The elongated crest 60 is spaced from the leading edge 42 and has an axis of elongation $A_{E2}$ that extends generally parallel to a portion of the suction side 40 that is directly adjacent to the elongated crest 60, i.e., a portion of the suction side 40 that can be intersected by a line extending from the crest 60 and perpendicular to the axis of elongation $A_{E2}$. The axis of elongation $A_{E2}$ of the crest 60 is preferably oriented at an angle, $\beta$, that is greater than an angle of the crest 50 relative to the axial direction. The suction side ridge 58 extends to the forward edge 56 of the end wall 30*a* and is configured to redirect flow upstream of the airfoil 34*a* to guide the purge flow 54 and to substantially reduce or eliminate formation of horseshoe vortices at the leading edge 42 and extending into the flow passage 46 along the suction side 40.

Figure 4:
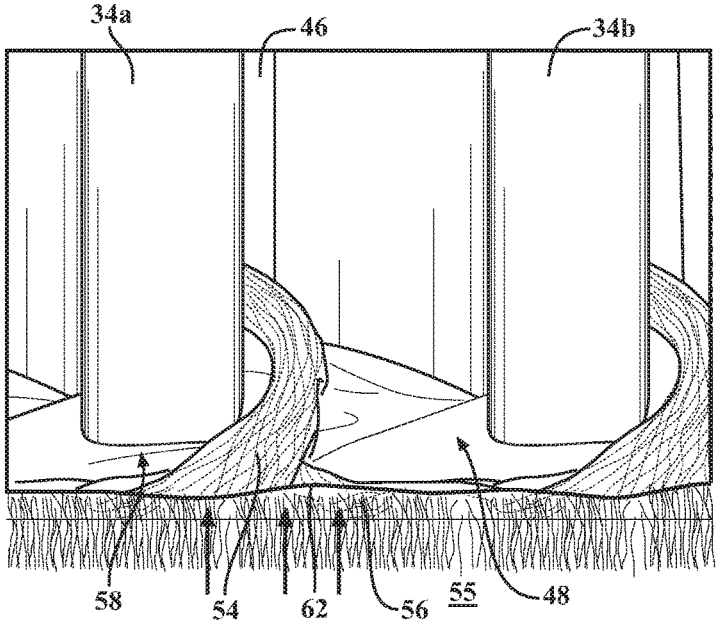
FIG. 4 is a perspective downstream view showing exemplary gas flows passing between a pair of airfoils on the end wall of FIG. 2.

The pressure side ridge 48 and suction side ridge 58 define a trough 62 therebetween. The trough 62 is formed as a low elevation channel beginning upstream of the leading edges 42 of the airfoils 34*a*, 34*b*, extending from the forward edge 56 of the inner end wall 30*a* into the flow passage 46, and directs the purge flow adjacent to the inner platform 30*a* into the flow passage 46 laterally centrally between the airfoils 34*a*, 34*b*. As can be seen in FIG. 4, the forward edge 56 is formed with an uneven or undulating surface, extending in the circumferential direction, to locate the inlet of the trough 62 at the gap 57 where the purge air exits the purge cavity 55

With reference to the airfoil 34*a* in FIG. 2, a mid-chord bulge 64 is located at the suction side 40, and is axially centered at about a mid-chord location 66. The mid-chord bulge 64 extends from a maximum elevation, depicted by an exemplary magnitude of "2", laterally to an outer edge 68. The elevation of the mid-chord bulge 64, extending along an intersection with the suction side 40, decreases in the axial forward and aft directions. Hence, the mid-chord bulge 64 can be described as a generally semi-spherical ridge or bulge that extends laterally from the suction side 40 toward the opposing pressure side 38 of the airfoil 34*b*.

Further, the mid-chord bulge 64 defines a higher elevation than the end wall adjacent to the mid-chord location 52 on the opposing pressure side 38 of the airfoil 32*b*. In particular, the area forward and aft of the pressure side mid-chord location 52 is formed without ridge or trough features, as depicted by the area of the pressure side 38 associated with exemplary magnitudes in the range of about "4" to "−4", forming a continuous declining slope in the aft direction. Additionally, these low level elevations extend laterally from the pressure side 38 toward the suction side 40 of the opposing airfoil 34*a*. That is, in accordance with an aspect of the invention, it can be seen in FIG. 2 that the contour line depicting the magnitude "0", and constant elevation contours to either side of the "0" magnitude contour line, extend from a location on the pressure side 38 to a laterally opposite location on the suction side 40 adjacent to the mid-chord bulge 64. The described low level elevations form a continuous low elevation channel 70 that extends in the circumferential direction between the mid-chord bulge 64 and the pressure side mid-chord location 52, e.g., within at least the axial span of contour lines in the range of about "4" to "−4", and can include an axial area extending within the range of about "6" to "−6".

The mid-chord bulge 64 defines a curved surface that requires the flow velocity to accelerate as it passes over the bulge 64, with an associated decrease in pressure at the mid-chord location 66 of the suction side 40. In accordance with an aspect of the invention, the low pressure region created by the bulge 64 accelerates secondary vortices away from the purge flow 54, reducing losses that could otherwise result from mixing of the purge flow 54 and secondary vortices.

It may be noted that the end wall contour includes additional troughs to facilitate control of vortex flows. Specifically, an upstream suction side trough 74 is located adjacent to the suction side 40 between the mid-chord bulge 64 and the suction side ridge 58, a downstream suction side trough 76 is located adjacent to the suction side 40 between the mid-chord bulge 64 and the trailing edge 44, and a downstream pressure side trough 78 is located adjacent to the pressure side 38 between the low elevation channel 70 and the trailing edge 44. It may be understood that the additional described troughs 74, 76, 78 function together with the ridges 48, 60, the mid-chord bulge 64 and the low elevation channel 70 to substantially reduced formation of vortices and to avoid or reduce mixing of the purge flow 54 and flows including secondary vortices.

As noted above, the contour line magnitude "0" can correspond to a baseline elevation, i.e., an elevation corresponding to an end wall without contouring (flat end wall), and the numerical designations for the contour line magnitudes generically denotes relative elevations forming the 3D contour on the end wall 30*a*. Each integer value of magnitude depicted by the contour lines and specified magnitudes in FIG. 2 may correspond to a predetermined change of elevation, specified as a percent of the airfoil span. For example, a change in elevation depicted by a change in magnitude of "1" may correspond to an elevation change equal to between 0.5% and 1.5% of the airfoil span.

As can be seen in FIG. 3, the incoming purge flow 54 flowing adjacent to the end wall passes through the trough 62, between the pressure side ridge 48 and the suction side ridge 58 (see also FIG. 4). From the above description, it may be understood that the pressure side ridge 48 is positioned at a circumferential location between the circumferential locations of the leading edge 42 of the airfoil 34*a* and the leading edge 42 of the adjacent airfoil 34*b* to direct flow centrally into the flow passage 46. The purge flow exits the trough 62, as designated by purge flow 54*a*, and passes into the low elevation channel 70 that is formed without ridges or troughs. In the area of the low elevation channel 70, the purge flow (designated 54*b*) flows laterally (circumferentially) and axially across the passage 46 along the low elevation channel 70. Hence, mixing of the purge flow 54 with the secondary vortices is substantially avoided or reduced, and losses associated with mixing are substantially reduced to improve the efficiency of the turbine 16.

Figure 5A:
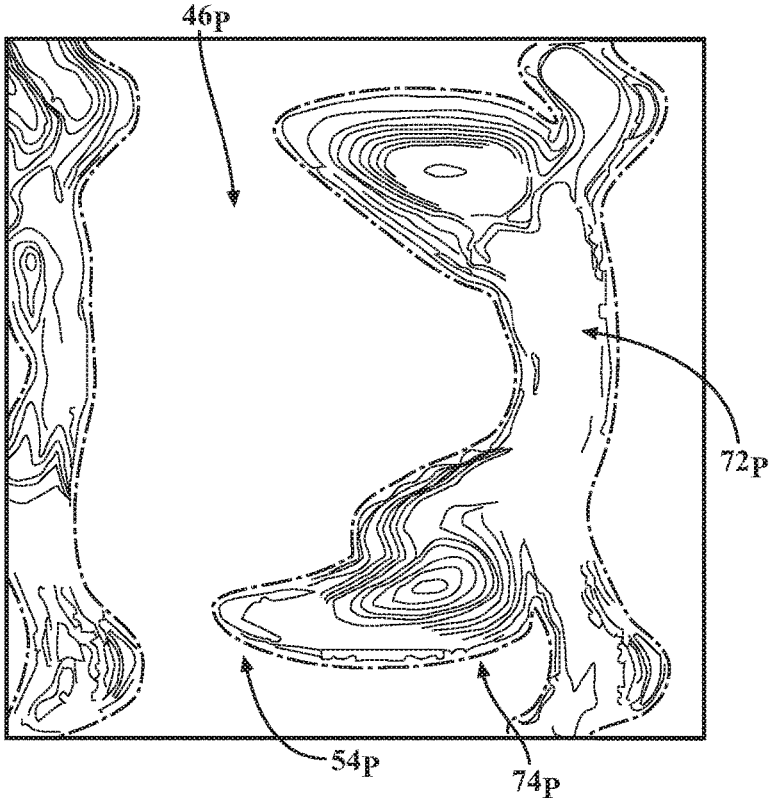
FIG. 5A PRIOR ART
FIG. 5A is an upstream elevation view, taken from a location 10% chord downstream of the airfoil, illustrating a prior art mixing of a purge flow and a secondary flow associated with vortices.
Figure 5B:
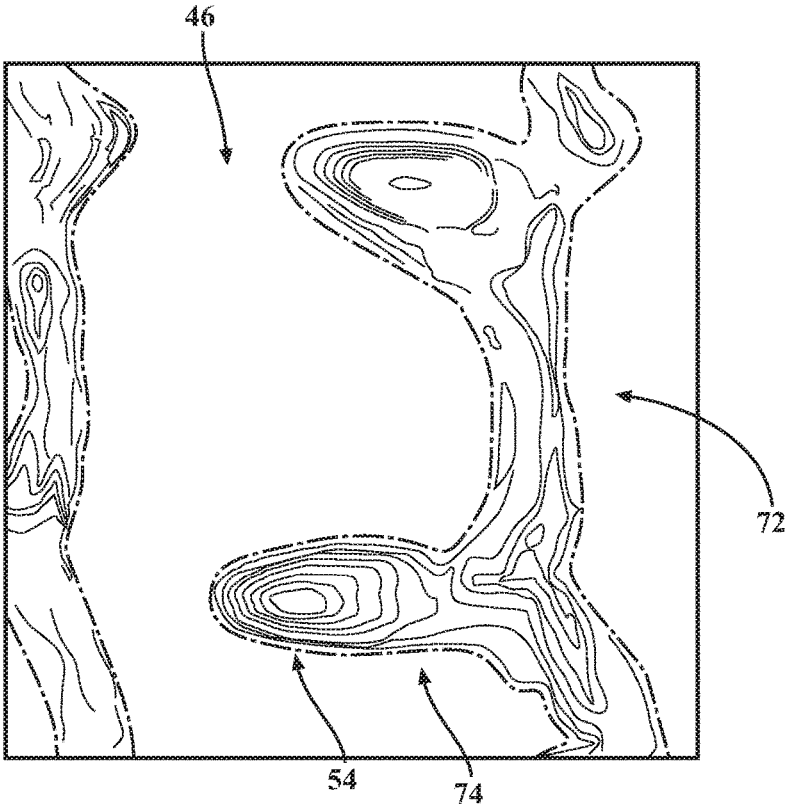
FIG. 5B is an upstream elevation view, taken from a location 10% chord downstream of the airfoil, illustrating a purge flow separated from a secondary flow associated with vortices, as provided by an end wall contour of the present invention.

FIGS. 5A and 5B further illustrate aspects of the invention. FIG. 5A depicts flows, based on CFD modeling, as they are believed to exist in a prior art flow passage $\mathbf{46}_P$ having a flat end wall. The flows depicted in FIG. 5A include a purge flow $\mathbf{54}_P$ that interacts with a secondary flow $\mathbf{72}_P$ including vortices, in which it can be seen that an interface region $\mathbf{74}_P$ between the purge flow $\mathbf{54}_P$ and the secondary flow $\mathbf{72}_P$ defines an area of substantial mixing between the flows. In contrast, FIG. 5B depicts flows, based on CFD modeling, that are believed to be formed in the flow passage 46 by the present 3D end wall contour, in which the purge flow 54 is substantially separated from the secondary flow 72 as depicted by an interface region 74 of reduced or minimal interaction. Hence, the present configuration for an end wall contour of the present invention can operate to form a separation between the purge flow 54 and the secondary flows, such as are formed by secondary vortices, to reduce losses normally associated with mixing of these two flows.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A contoured turbine airfoil assembly including:

an end wall formed by platforms located circumferentially adjacent to each other;

a row of airfoils integrally joined to the end wall and spaced laterally apart to define flow passages therebetween for channeling gases in an axial direction;

each of the airfoils including a concave pressure side and a laterally opposite convex suction side extending in a chordwise direction between opposite leading and trailing edges, the chordwise direction extending generally in the axial direction;

troughs defined in the end wall and located forward of the leading edges of the airfoils and extending to an axial location at least even with the leading edges of the airfoils, the troughs having a direction of elongation aligned to direct flow into the flow passage centrally between each pair of airfoils, and wherein the end wall adjacent to a suction side mid-chord location of each airfoil includes a mid-chord bulge, the mid-chord bulge defining a higher elevation than a circumferentially opposite, pressure side mid-chord location of an adjacent airfoil.

2. The airfoil assembly of claim 1, wherein each trough is defined between a pressure side ridge and a suction side ridge for each pair of airfoils, each pressure side ridge extending from a pressure side of an associated airfoil forwardly of the leading edge of the associated airfoil and the suction side ridge having an elongated crest extending adjacent and generally parallel to the suction side of an associated airfoil and located forward of the leading edges of the airfoils.

3. The airfoil assembly of claim 1, where the trough extends from an upstream edge of the end wall and the upstream edge of the end wall defines an undulating surface extending in the circumferential direction.

4. The airfoil assembly of claim 1, wherein a continuous low elevation channel is defined extending in the circumferential direction between the mid-chord bulge and the pressure side mid-chord location at the adjacent airfoil.

5. The airfoil assembly of claim 4, wherein the continuous low elevation channel is defined by a region having an axial extent without ridges and troughs, and extending circumferentially between the mid-chord bulge and the pressure side mid-chord location at the adjacent airfoil.

* * * * *